US005779820A

United States Patent [19]

Hauser et al.

[11] Patent Number: 5,779,820

[45] Date of Patent: Jul. 14, 1998

[54] PROCESS FOR PRODUCING A FERRITIC STAINLESS STEEL HAVING AN IMPROVED CORROSION RESISTANCE, ESPECIALLY RESISTANCE TO INTERGRANULAR AND PITTING CORROSION

[75] Inventors: Jean-Michel Hauser; Pascale Haudrechy, both of Ugine, France

[73] Assignee: Usinor Sacilor, Puteaux, France

[21] Appl. No.: 819,371

[22] Filed: Mar. 17, 1997

[51] Int. Cl.[6] ..... C21D 9/00; C21D 8/02; C22C 38/44

[52] U.S. Cl. ..... 148/325; 148/605; 148/609; 420/68

[58] Field of Search ..... 148/605, 607, 148/608, 609, 654, 661, 325; 420/68, 69

[56] References Cited

U.S. PATENT DOCUMENTS 4,119,765 10/1978 Pinnow et al. ..... 420/68

5,302,214 4/1994 Uematsu et al. ..... 420/69

FOREIGN PATENT DOCUMENTS

A-0 478 790 4/1992 European Pat. Off. .

A-2 349 659 11/1977 France .

A-2348275 11/1977 France .

A-3221087 12/1983 Germany .

*Primary Examiner*—Deborah Yee

*Attorney, Agent, or Firm*—Oblon, Spivak, McClelland, Maier & Neustadt, P.C.

[57] ABSTRACT

The present invention relates to a process for producing a ferritic stainless steel having an improved corrosion resistance, and especially resistance to intergranular corrosion and to pitting corrosion. The steel is subjected, in a first phase, to cooling at a rate of between 400° C. and 600° C./hour down to a temperature of 900° C. and then, in a second phase, to rapid cooling at a rate of between 1200° C. and 1400° C./h.

12 Claims, 5 Drawing Sheets

PROCESS FOR PRODUCING A FERRITIC STAINLESS STEEL HAVING AN IMPROVED CORROSION RESISTANCE, ESPECIALLY RESISTANCE TO INTERGRANULAR AND PITTING CORROSION

BACKGROUND OF THE INVENTION

1. Field of the Invention

The present invention relates to a process for manufacturing a ferritic steel having an improved corrosion resistance, and especially resistance to intergranular and pitting corrosion.

2. Discussion of the Background

Japanese Patent No. 62,250,150 (Nippon Kokan) discloses a corrosion-resistant ferritic stainless steel whose composition is as follows: carbon less than 0.04%, silicon less than 1%, manganese less than 1%, nickel less than 6%, chromium between 19 and 28%, molybdenum between 1 and 6%, nitrogen less than 0.03%, phosphorus less than 0.06% and sulfur less than 0.03%. This steel may also contain niobium and/or titanium.

That document presents a ferritic steel having a high corrosion resistance, used for withstanding a mixture of phosphoric acid, of sulfuric acid and of chlorine and fluorine ions.

Without a specific conversion, this steel remains difficult to produce. In addition, it is known that steels resistant to acid media are steels containing, in their composition, a relatively large amount of nickel.

Also known is Patent DE 3,221,087 (Thyssen) relating to the manufacture of a so-called superferritic CrMoNi stainless steel which includes conventional oxygen refining using an AOD or VOD process, continuous casting of billets or slabs, optional intermediate cooling, and annealing followed by conversion into blooms and end- or semi-finished products. The superferritic stainless steel has the following composition: carbon between 0.01 and 0.05%, silicon less than 2%, manganese less than 1%, nickel between 1 and 4%, chromium between 21 and 31%, molybdenum between 1.5 and 3.5%, nitrogen between 0.01 and 0.08%, phosphorus less than 0.0025%, sulfur less than 0.01%, titanium less than 0.24%, zirconium between 0.005 and 0.5%, aluminum between 0.002 and 0.12%, niobium between 0.1 and 0.6% and copper less than 3%. This steel may also contain calcium, magnesium, cerium and boron, and the elements of the composition satisfy the following relationships:

% Cr+10×(% Mo)+6×(% Si) lying between 48 and 58;

% Nb+% Zr+3.5×(% Al+2×% Ti) lying between 8 and 16×(% C+% N)

In this document, it is specified that some of the aluminum may be replaced by doubling the amount of titanium on condition that there is at least 0.002% of aluminum. The steel is preferably hot rolled or forged directly after continuous casting, without intermediate cooling.

OBJECTS OF THE INVENTION

One object of the invention is to improve the corrosion resistance of a ferritic steel, especially the resistance to intergranular and pitting corrosion, while at the same time maintaining a conversion process compatible with the conversions of common so-called 17% chromium ferritic steels.

DETAILED DESCRIPTION OF THE INVENTION

One subject of the invention is a process for producing a ferritic stainless steel having an improved corrosion resistance, and especially resistance to intergranular corrosion and to pitting corrosion. The steel so produced is part of the invention. In the invention process steel, preferably in slab form, containing in its composition (by weight based on total weight):

18% <chromium<27%
1% <molybdenum<3%
1% <nickel<3%
manganese<1%
silicon<1%
carbon<0.030%
nitrogen<0.030%
0.075% <titanium<0.20%
0.20% <niobium<0.50%
sulfur<0.01%
phosphorus<0.1% the balance being mostly or wholly iron and impurities resulting from the smelting of the materials necessary for the production, is subjected, in a first phase, to cooling from, preferably, above 950° C., more preferably 1200°–1300° C., at a rate of between 400° C. and 600° C./hour down to a temperature of from 950°–850° C., preferably 900° C., and then, in a second phase, to more rapid cooling at a rate of between 1200° C. and 1400° C./h to a temperature of from 650°–550° C. All values between all given temperature and cooling rate ranges provided herein are included as part of the invention as are all subranges therebetween. For example, cooling rates of 450°, 500° and 550° C./hour may be used in the first phase, and cooling rates of 1250°, 1300° and 1350° C./hour may be used in the second phase.

The other characteristics of the invention which may be present singly or in combinations of two or more are:

after hot rolling, the strip obtained is subjected to rapid cooling and then coiled at a temperature of less than 600° C. and preferably at a temperature close to (±10%) 550° C.

preferably, the steel, in slab form, contains in its composition by weight:

22% <chromium<27%
1% <molybdenum<3%
1% <nickel<3%
manganese<1%
silicon<1%
carbon<0.030%
nitrogen<0.030%
0.075% <titanium<0.20%
0.20% <niobium<0.50%
sulfur<0.01%
phosphorous<0.1% the steel furthermore contains, in its composition by weight, less than 0.20% of copper.

the elements of the composition of the steel furthermore satisfy the following relationship:

0.07% <ΔNb=% Nb+¾% Ti−7(% C+% N)<0.4%.

The invention also relates to a ferritic stainless steel obtained by the above process and having improved corrosion resistance, especially resistance to intergranular and pitting corrosion, defined in its composition by weight based on total weight:

18% <chromium<27%
1% <molybdenum<3%
1% <nickel<3%
manganese<1%
silicon<1%
carbon<0.030%
nitrogen<0.030%

0.075% <titanium<0.20%
0.20% <niobium<0.50%
sulfur<0.01%
phosphorus<0. 1% the balance being mostly or wholly iron and impurities resulting from the smelting of the materials necessary for the production.

Preferably, the steel is defined in its composition by weight as follows:

22% <chromium<27%
1% <molybdenum <3%
1% <nickel<3%
0.3% <manganese<0.5%
0.3% <silicon<0.5%
carbon<0.030%
nitrogen<0.030%
0.075% <titanium<0.20%
0.20% <niobium<0.50%
aluminum<0.05%
sulfur<0.01%
phosphorus<0.1% the balance being mostly or wholly iron and impurities resulting from the smelting of the materials necessary for the production.

The other characteristics of the invention are:

the elements of the composition satisfy the following relationship:

$0.07\% \leqq \Delta Nb = \%\ Nb + 7/4\%\ Ti - 7(\%\ C + \%\ N) \leqq 0.4\%$.

the composition furthermore contains less than 0.20% of copper.

The description which follows, and the appended figures, all given by way of non-limiting example, will make the invention clearly understood.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Figure 1:
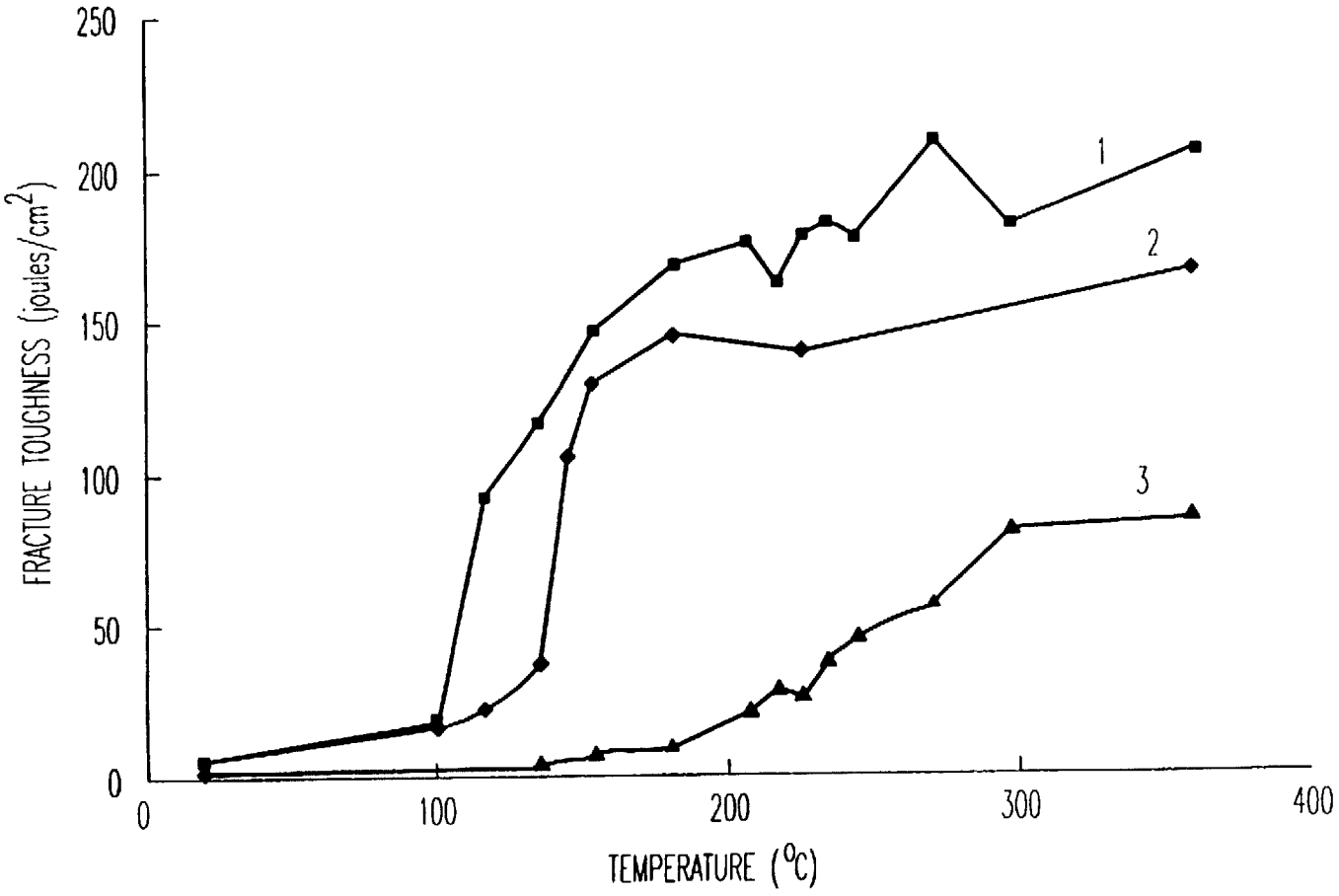
FIG. 1 shows three ductile-brittle transition curves for a steel of composition A (11721) according to the invention.

The group of steels having more than 18% of chromium includes steels which are difficult to convert because of the high proportion of chromium which they contain. However, the high chromium contents have the effect of increasing the corrosion resistance, compared with so-called 17% chromium ferritic steels.

Aluminum and zirconium, introduced into the composition in residual amounts, are contained in a proportion of impurities due to the production.

Copper typically cannot be introduced in a smaller amount since it is contained in the composition of the base materials used for production of the steel.

Molybdenum improves the resistance to generalized corrosion in acid medium and to pitting corrosion. However, it is preferably limited in concentration in order to avoid problems in the area of hot fracture toughness.

Nickel improves the resistance to corrosion in acid medium, but a maximum limit is preferably imposed since too great an amount of nickel embrittles the steel.

The steel according to the invention, preferably in the form of slab, undergoes a particular heat treatment in order to reduce its embrittlement, especially when the steel is highly stabilized. This is because it has been observed that uncontrolled cooling of the steel during its conversion produces embrittlement of the said steel.

In a preferred aspect of to the invention, a slab of the steel is subjected to through-cooling at a rate of between 400° and 600° C./hour down to a temperature of 900° C. Next, the slab is subjected to rapid through-cooling at a rate of between 1200° and 1400° C./hour, for example by immersing the slab in a pool of water until this reaches a temperature of approximately 550° C.

EXAMPLES

Three types of cooling were tested and compared, by applying the process to a slab highly stabilized with niobium and titanium, with ΔNb equal to 0.33.

In the heat treatment, the slab is subjected to cooling in a pool for a period of less than 10 min. Before entering the pool at a temperature of approximately 900° C., the slab is cooled through at a rate of about 600° C./h, and then at a rate of 1300° C./h on going into the pool down to at least a temperature of approximately 550° C.

The chemical compositions of steels A (11721) and B (11722) according to the invention are given in Table 1.

TABLE 1

Chemical compositions of the steels

| Steels | Composition | | | | | | | | | | | | | |
|---|---|---|---|---|---|---|---|---|---|---|---|---|---|---|
| | C | Si | Mn | Ni | Cr | Mo | Cu | S | Al | Ti | Nb | $O_2$ | $N_2$ | ΔNb |
| Ref 316 L | .017 | .588 | 1.636 | 11.51 | 17.65 | 2.15 | .056 | .0032 | .003 | .004 | .004 | | .030 | |
| Ref. F18MT | .010 | .351 | .401 | .233 | 17.96 | 2.109 | .007 | .0012 | .041 | .071 | .375 | 19/23 | .019 | .296 |
| Steel A (11721) | .017 | .347 | .391 | 2.032 | 22.79 | 2.015 | .011 | .0017 | .005 | .113 | .374 | 32/32 | .018 | .327 |
| Steel B (11722) | .018 | .368 | .397 | 1.98 | 23.00 | 2.021 | .010 | .0021 | <.002 | .110 | .373 | 33/36 | .017 | .320 |
| Steel C (11519) | .017 | .322 | .405 | 2.05 | 23.08 | 2.02 | .121 | .0053 | .025 | .117 | .440 | 43/42 | .015 | .421 |
| Steel D (11694) | .027 | .307 | .419 | 2.04 | 23.22 | 2.10 | .010 | .0016 | .035 | .049 | .300 | 25/29 | .022 | .043 |
| Steel E (11605) | .016 | .404 | .406 | 1.99 | 23.12 | 1.94 | .010 | .0011 | .033 | .099 | .352 | 29/36 | .015 | .308 |
| Steel F (11606) | .017 | .313 | .409 | 1.97 | 23.09 | 1.93 | .009 | .0019 | .048 | .072 | .250 | 27/32 | .020 | .117 |

FIG. 1 shows three ductile-brittle transition curves for steel A (11721). Curves 1 and 2 are the ductile-brittle transition characteristics of steel A, according to the invention, this steel having been rapidly cooled in the pool for 10 to 5 min, respectively. Curve 3 shows the brittle-ductile transition characteristic of steel A, this steel not having been rapidly cooled.

Curve 2 shows a transition temperature at 140° C. and relatively high hot fracture toughness values at a temperature of between 190° C. and 360° C., while without cooling, as shown by Curve 3, the steel remains brittle with a transition temperature of 296° C. and a low hot fracture toughness, that is to say approximately 80 J/cm$^2$, at a temperature of 350° C.

The fact of increasing the time spent in the pool improves the fracture toughness characteristics little. With 10 minutes spent in the pool, a transition temperature of 113° C. and hot fracture toughness values greater than only approximately 30% are obtained. In addition, the temperature of the slab on leaving the pool is lower, which can cause problems, for example when grinding the slab.

The cooling according to the invention avoids the precipitation of embrittling intermetallic compounds of the Mo-enriched $Fe_2Nb$ type.

Figure 2:
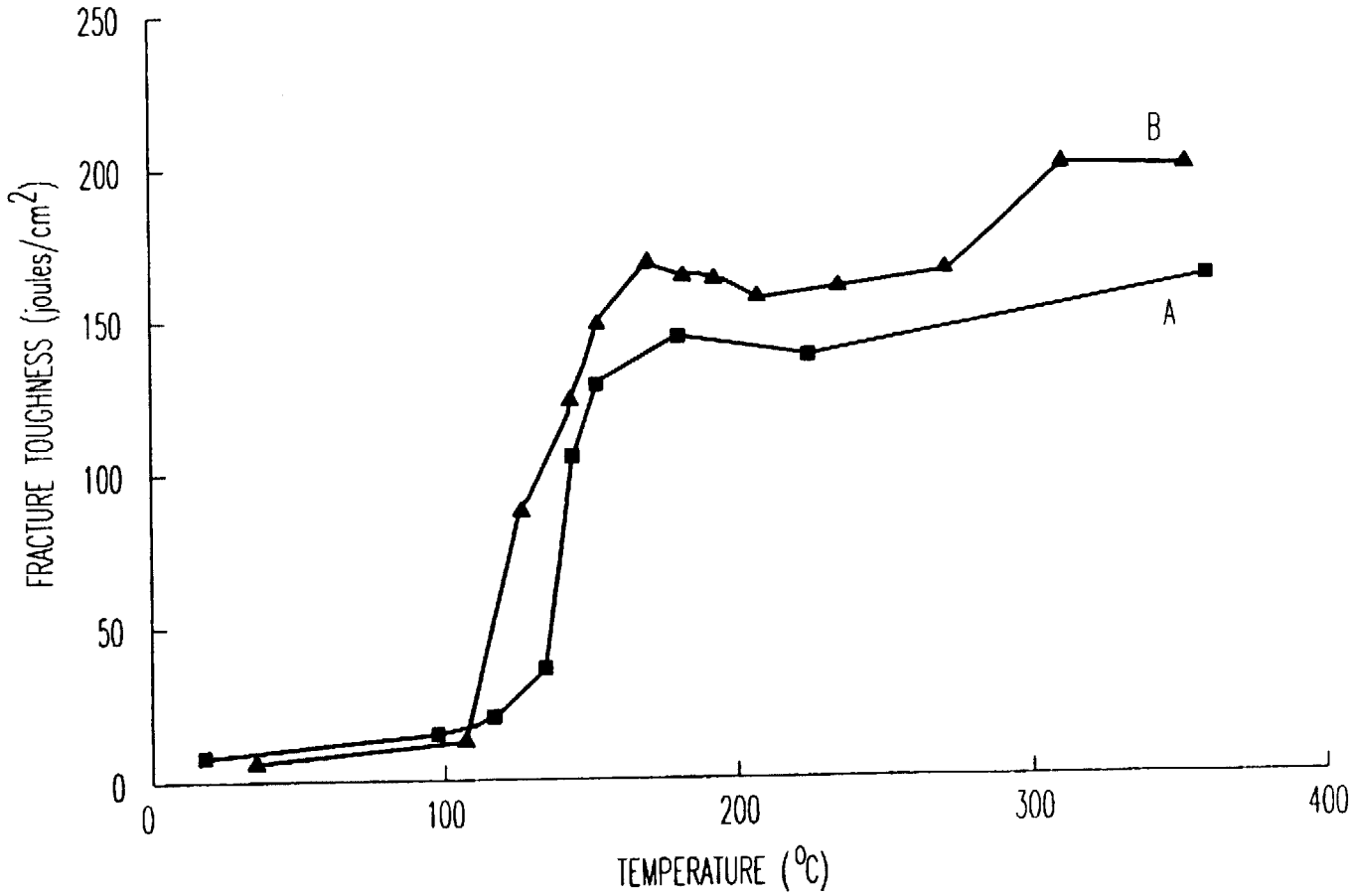
FIG. 2 shows two ductile-brittle transition curves for a steel of composition B (11722) according to the invention.

FIG. 2 shows two characteristic ductile-brittle transition curves for steel B (11722) compared with a fracture toughness characteristic of steel A. It will be observed that the cooling gives a ductile-brittle transition temperature of 124° C. and hot fracture toughness values at temperatures of between 180° C. and 260° C. of about 160 J/cm$^2$.

These values show that steel B according to the invention has improved characteristics compared with steel A, this being explained by the fact that steel A is less stabilized. In fact, the composition of the steel A satisfies the relationship: $\Delta Nb=0.32\%$.

According to the invention, after the slab has been hot rolled, the strip obtained is subjected to rapid cooling and is then coiled at a temperature of less than 600° C., preferably at a temperature close to 550° C.

Tests were carried out using steel C (11519) whose composition is given in Table 1. This steel is highly stabilized.

Figure 3:
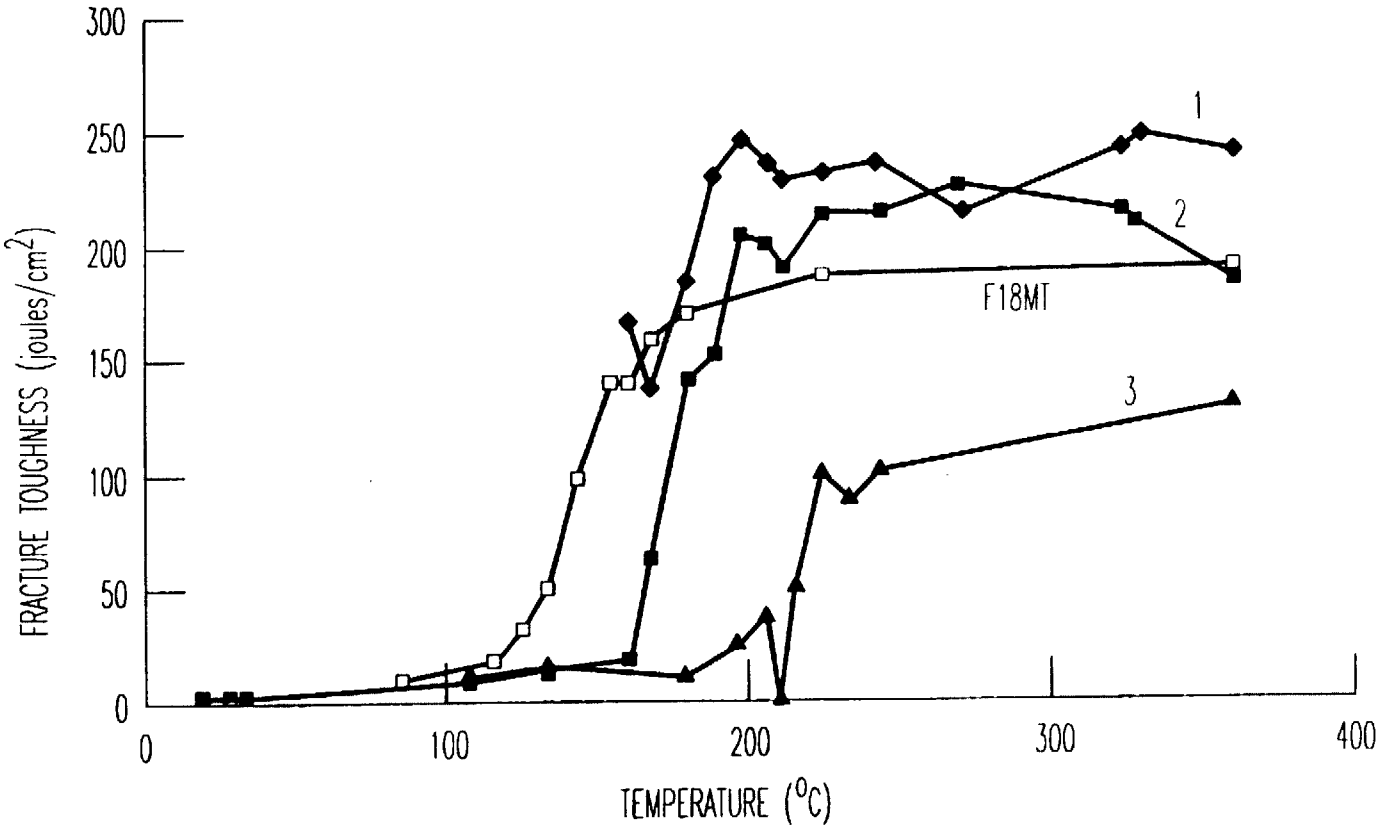
FIG. 3 shows ductile-brittle transition curves after rapid cooling of the hot-rolled steel strip.

The fracture toughness characteristics shown in FIG. 3 relating to the steel according to the invention are compared with a reference steel of the F18MT type, a 17% chromium steel, which has not undergone rapid cooling.

A very marked improvement resulting from the rapid cooling of the hot-rolled strip is observed. The transition temperature moves, from approximately 220° C., to 172° C. for rapid cooling and coiling at 600° C. and to 147° C. for coiling at 550° C. It may be noted that Curve 1, which represents steel C (11519) subjected to rapid cooling and coiling at 550° C., is similar to the characteristic of the reference steel. The same applies to Curve 2 which represents the characteristic of steel C (11519) subjected to rapid cooling and coiling at 600° C., Curve 3 being a comparative curve of a characteristic of steel C according to the invention, but which has not been subjected to rapid cooling.

The heat treatment according to the invention makes it possible to obtain, for a steel containing more than 18% chromium, characteristics comparable to those of so-called 17% chromium steels. It substantially improves its fracture toughness properties, especially by lowering the ductile-brittle transition temperatures.

The carbon and nitrogen contents of the steel according to the invention are limited in order to reduce the intergranular corrosion phenomena.

It has been observed that the nickel and molybdenum contents must be limited.

Figure 4:
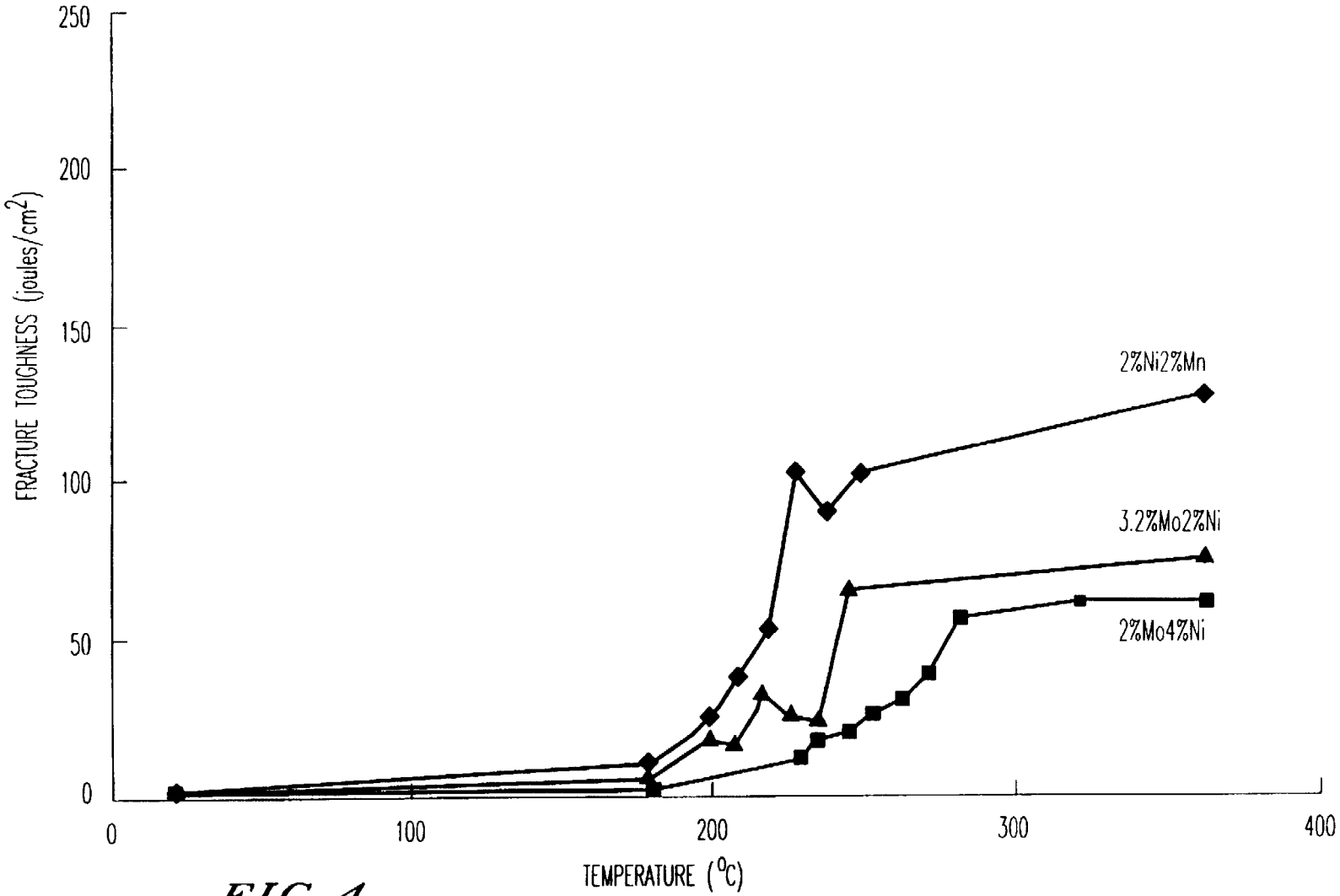
FIG. 4 shows ductile-brittle transition curves as a function of varying contents of nickel and molybdenum.

FIG. 4 shows a characteristic ductile-brittle transition curve of a steel C according to the invention containing 2% molybdenum and 2% nickel, this characteristic being, on the one hand, compared with that of a steel of the same general composition and containing 3.2% molybdenum and 2% nickel, and, on the other hand, with that of a steel of the same general composition and containing 2% molybdenum and 4% nickel.

Comparison of these three curves shows that it is necessary, according to the invention, to limit the molybdenum and nickel contents to a value of less than 3%.

From the corrosion standpoint, it is necessary to define the minimum contents of the stabilizing elements titanium and niobium in order to ensure intergranular corrosion resistance. As previously, the relationship:

$\Delta Nb=\%\ Nb+\frac{7}{4}\times\%\ Ti-7\times(\%\ C+\%\ N)$ corresponds to the excess of stabilizers after the carbides and nitrides have precipitated.

The intergranular corrosion resistance is evaluated by the Strauss test applied to specimens on which a line of TIG melting has been traced.

The tested specimens of steel D (11694) satisfying the relationship $\Delta Nb$ equal to 0.043 showed no cracking.

Likewise, on more stabilized steels, such as steel E (11605) and steel F (11606) for example, it is observed that there is no disbandment after the Strauss test. At greater levels of stabilization, for example $\Delta Nb$ greater than 0.1, there is no loosening, while at the stabilization level of steel D this is observed, without thereby leading to the appearance of cracks. The value of $\Delta Nb$ equal to 0.043 is therefore really a minimum level to ensure intergranular corrosion resistance, below which cracks will occur.

Figure 5:
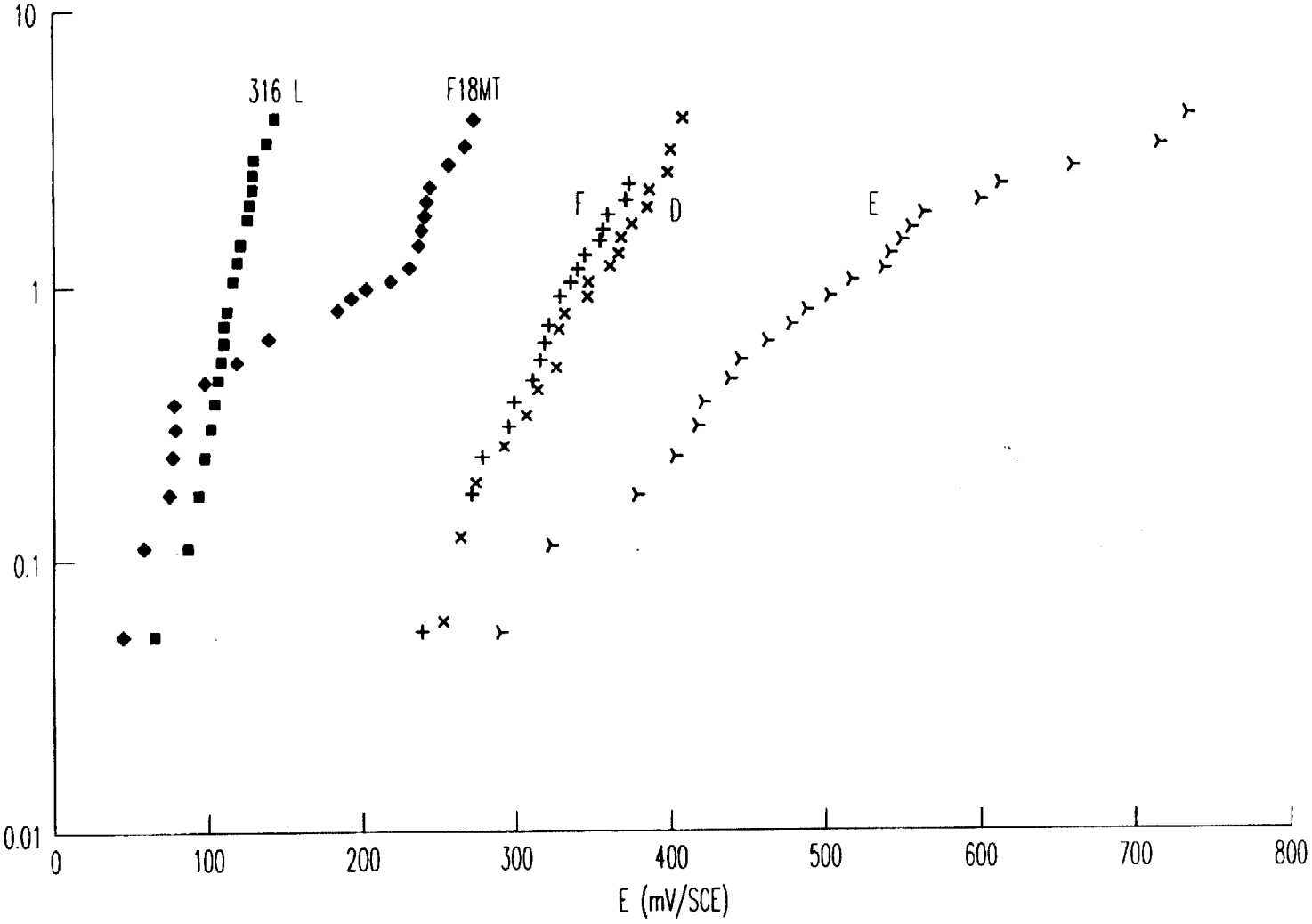
FIG. 5 shows comparative pitting-corrosion test curves.

FIG. 5 shows pitting corrosion characteristics on polished specimens, aged in air and then subjected to polarization with a 100 mV min$^{-1}$ scan, in a 0.5M aqueous sodium chloride solution having a pH equal to 6.6 and a temperature of 70° C.

The various characteristics shown in the figure indicate that steels E and F have greater pitting corrosion resistance than steels taken as a reference, such as 316 L and F 18 MT steels.

From the standpoint of crevice corrosion, steel C (11519) and steel D (11694) have been compared with a 316 L reference steel. Steel C has titanium and niobium contents higher than steel D. These elements appear to have no appreciable influence on the crevice corrosion behavior of the steel.

This comparison was made on polished specimens, aged in air and then subjected to polarization at a potential of −750 mV/SCE for 2 min followed by holding at a floating potential for 15 min. The specimens are then subjected to a 10 mV.min$^{-1}$ scan between −750 mV/SCE and 1000 mV/SCE, the specimens being immersed in a 2M aqueous sodium chloride solution having a pH of 1.0 and 1.5.

The table below collates, for the steels tested, the values of the potentials and current densities corresponding to the activity peaks measured on the polarization curves in a 2M NaCl solution.

| | pH = 1.0 | | pH = 1.5 | |
|---|---|---|---|---|
| | I(μA/cm²) | E(mV/SCE) | I(μA/cm²) | E(mV/SCE) |
| 316 L | 70 | −335 | 15 | −370 |
| Steel C | 91 | −474 | 1.5 | −340 |
| Steel D | 47 | −478 | 1.0 | −338 |

These results show that steel D, less stabilized than steel C from the standpoint of the titanium and niobium concentration, behaves in the same way as the said steel C. The activity peaks occur at the same potential and have a maximum intensity of the same order of magnitude.

It will be noted that the variations in the titanium and niobium contents do not alter the crevice corrosion behavior of the steels according to the invention.

In general, a value of ΔNb equal to 0.040% is regarded as a minimum value in order to ensure intergranular corrosion resistance.

As a titanium content greater than 0.075% is fixed by the requirements for pitting corrosion resistance, the minimum niobium content is therefore preferably greater than 0.30%.

French patent application 96 03258 is incorporated herein by reference.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for producing a ferritic stainless steel, wherein steel having a composition comprising, by weight based on total weight:

18% <chromium<27%

1% <molybdenum<3%

1% <nickel<3% manganese<1% silicon<1% carbon<0.030% nitrogen<0.03 0%

0.075% <titanium<0.20%

0.20% <niobium<0.50% sulfur<0.01% phosphorus<0.1% iron and impurities resulting from smelting materials necessary for production of said steel, is subjected, in a first phase, to cooling from a temperature above 950° C. at a rate of between 400° C. and 600° C./hour down to a temperature of 950°–850° C. and then, in a second phase, to rapid cooling at a rate of between 1200° C. and 140° C./h to a temperature of from 550° C.–650° C.

2. The process as claimed in claim 1, wherein the steel is subjected to hot rolling after the first phase cooling but before being subjected to rapid cooling and is then coiled at a temperature of less than 600° C.

3. The process as claimed in claim 1, wherein the steel is in slab form, and its composition comprises by weight based on total weight:

22% <chromium<27%

1% <molybdenum<3%

1% <nickel<3% manganese<1% silicon<1% carbon<0.030% nitrogen<0.030%

0.075% <titanium<0.20%

0.20% <niobium<0.50% sulfur<0.01%.

phosphorus<0.1%.

4. The process as claimed in claim 1, wherein the steel further comprises, in its composition by weight, less than 0.20% of copper.

5. The process as claimed in claim 1, wherein the elements of the composition of the steel satisfy the following relationship:

0.07% <ΔNb=% Nb+7/4% Ti−7(% C+% N)<0.4%.

6. A ferritic stainless steel obtained by the process as claimed in claim 1.

7. A ferritic stainless steel obtained by the process as claimed in claim 3.

8. The steel as claimed in claim 6, wherein the elements of the steel composition satisfy the following relationship:

0.07% <ΔNb=% Nb+7/4% Ti−7(% C+% N)<0.4%.

9. The steel as claimed in claim 6, wherein the steel composition furthermore contains less than 0.20% of copper.

10. The steel as claimed in claim 7, wherein the elements of the steel composition satisfy the following relationship:

0.07% <ΔNb=% Nb+7/4% Ti−7(% C+% N)<0.4%.

11. The steel as claimed in claim 7, wherein the steel composition furthermore contains less than 0.20% of copper.

12. The process of claim 1, wherein said steel is at a temperature of from 1200°–1300° C. when first phase cooling is initiated.

* * * * *

UNITED STATES PATENT AND TRADEMARK OFFICE

CERTIFICATE OF CORRECTION

PATENT NO. : 5,779,820

DATED : July 14, 1998

INVENTOR(S) : Jean-Michel HAUSER, et al.

It is certified that error appears in the above-identified patent and that said Letters Patent is hereby corrected as shown below:

On the title page, item [30], Foreign Application Priority Data is missing. It should be:

--[30] Foreign Application Priority Data

Mar. 15, 1996 [FR] France ..... 96 03258--

Signed and Sealed this

Twenty-third Day of February, 1999

*Attest:*

*Attesting Officer*

Q. TODD DICKINSON

*Acting Commissioner of Patents and Trademarks*